United States Patent [19]

Harada

[11] Patent Number: 4,583,835

[45] Date of Patent: Apr. 22, 1986

[54] IMAGE CONTROL DEVICE FOR ELECTROPHOTOGRAPHIC COPIER

[75] Inventor: Masahide Harada, Tokyo, Japan

[73] Assignee: Ricoh Company, Ltd., Tokyo, Japan

[21] Appl. No.: 558,747

[22] Filed: Dec. 7, 1983

[30] Foreign Application Priority Data

Dec. 10, 1982 [JP] Japan ..... 57-216660

[51] Int. Cl.[4] ..... G03G 15/00

[52] U.S. Cl. ..... 355/14 CH; 355/14 D; 355/14 R; 250/325

[58] Field of Search ..... 355/3 CH, 14 CH, 14 R, 355/14 D; 361/229, 235; 250/324, 325, 326

[56] References Cited

U.S. PATENT DOCUMENTS

| | | | |
|---|---|---|---|
| 3,805,069 | 4/1974 | Fisher | 361/229 X |
| 4,313,671 | 2/1982 | Kurn | 355/14 D |
| 4,318,610 | 3/1982 | Grace | 355/14 CH X |

FOREIGN PATENT DOCUMENTS

| | | | |
|---|---|---|---|
| 0073055 | 6/1979 | Japan | 355/14 CH |
| 0066445 | 4/1982 | Japan | 355/14 CH |

*Primary Examiner*—A. T. Grimley
*Assistant Examiner*—J. Pendegrass
*Attorney, Agent, or Firm*—David G. Alexander

[57] ABSTRACT

In an image control device for an electrophotographic copier, a temperature on the surface of a photoconductive element or in the vicinity thereof is sensed. The amount of charge deposited on the photoconductive element is controlled to maintain the potential in a background constant in response to a sensed temperature.

8 Claims, 7 Drawing Figures

IMAGE CONTROL DEVICE FOR ELECTROPHOTOGRAPHIC COPIER

BACKGROUND OF THE INVENTION

The present invention relates to an image control device for an electrophotographic copier and, more particularly, to an image control device for reproducing a desirable image by compensating for a change in the surface temperature of a photoconductive element, which may result from a temperature characteristic of the photoconductive element.

As well known in the art, an electrophotographic copier uses a photoconductive element which is made up of an electroconductive base and a photoconductive insulating layer formed on the base. The photoconductor repeatedly undergoes sequential steps of charging, exposing, developing, transferring, clearing and charge dissipating, thereby producing a number of copies within a short period of time. Such photoconductors have a given temperature characteristic, more or less. Therefore, as the surface temperature of the photoconductor is elevated due to, for example, an elevation in ambient temperature in summer or frequent or continuous operation of the copier, the dark resistance is lowered to lower the surface potential and, thereby, the density of developed images, even if the amount of charge deposited on the photoconductor is constant. An implementation heretofore employed to eliminate the decrease in the photoconductor surface photential in such a situation is increasing a charging current to the photoconductor, that is, increasing a voltage applied to a charger to increase the amount of charge, in accordance with the elevation of the photoconductor surface temperature. However, exposure of the photoconductor to image light after such charging lowers the potential more in a dark area than in a light area due to the resulting elevation of the photoconductor temperature, so that lowering of the potential may be prevented in an image portion where the photoconductor surface potential is relatively high, but not in an image portion and background where it is relatively low. Therefore, while a desirable image may be reproduced when a document to be copied has a high image density, the image density and, therefore, the quality of the reproduced image is lowered when the document has a low image density or low contrast due to the decrease in the potential of low density image portions.

SUMMARY OF THE INVENTION

It is therefore an object of the present invention to provide an improved image control device for an electrostatic copier which is capable of desirably reproducing even a low density and low contrast documents despite the rise of temperature of a photoconductive element.

It is another object of the present invention to provide a generally improved image control device for an electrophotographic copier.

An image control device of the present invention is applied to an electrophotographic copier which includes a photoconductive element, a charger for depositing a uniform electrostatic charge on a surface of the photoconductive element, and a developing unit for supplying a toner. The image control device comprises a surface temperature sensor for sensing a temperature in the vicinity of the surface of the photoconductive element to generate a surface temperature signal which has a level corresponding to the sensed temperature, a reference temperature signal generator for generating a reference temperature signal having a level which corresponds to a predetermined reference temperature, a charger control circuit for comparing the level of the surface temperature signal with the level of the reference temperature signal and generating a charger drive signal when the level of the surface temperature signal is higher than the level of the reference temperature signal, and a charger driver for increasing a voltage applied to the charger by a predetermined amount in response to the charger drive signal, thereby increasing an amount of charge on the surface of the photoconductive element, whereby a potential in a background of the surface of the photoconductive element is kept constant.

In accordance with the present invention, in an image control device for an electrophotographic copier, a temperature on the surface of a photoconductive element or in the vicinity thereof is sensed. The amount of charge deposited on the photoconductive element is controlled to maintain the potential in a background constant in response to a sensed temperature.

The above and other objects, features and advantages of the present invention will become apparent from the following detailed description taken with the accompanying drawings.

DESCRIPTION OF THE PREFERRED EMBODIMENTS

While the image control device for an electrophotographic copier of the present invention is susceptible of numerous physical embodiments, depending upon the environment and requirements of use, substantial numbers of the herein shown and described embodiments have been made, tested and used, and all have performed in an eminently satisfactory manner.

Figure 1:
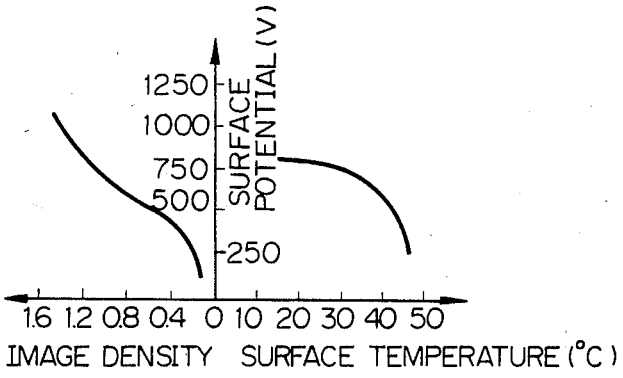
Fig. 1 PRIOR ART
FIG. 1 is a graph showing a relationship between a surface temperature and a surface potential of a photoconductive element and an image density in accordance with a prior art image control device.
Figure 2:
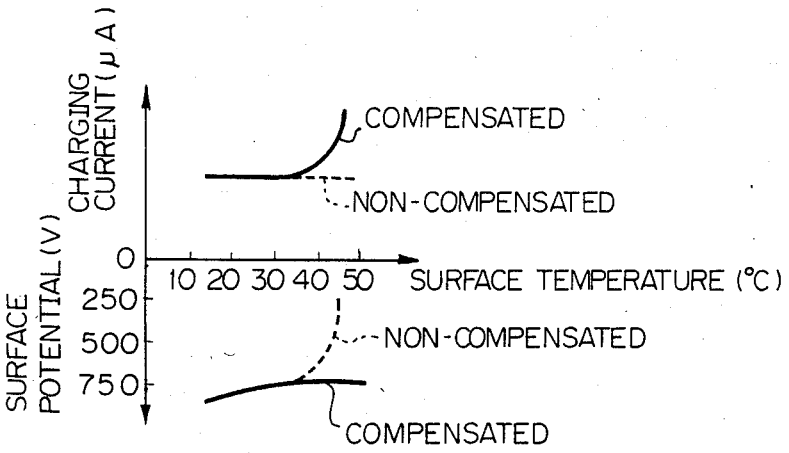
Fig. 2 PRIOR ART
FIG. 2 is a graph showing a relationship between a charging current, a surface temperature and a surface potential of a photoconductive element in accordance with the prior art device.
Figure 3:
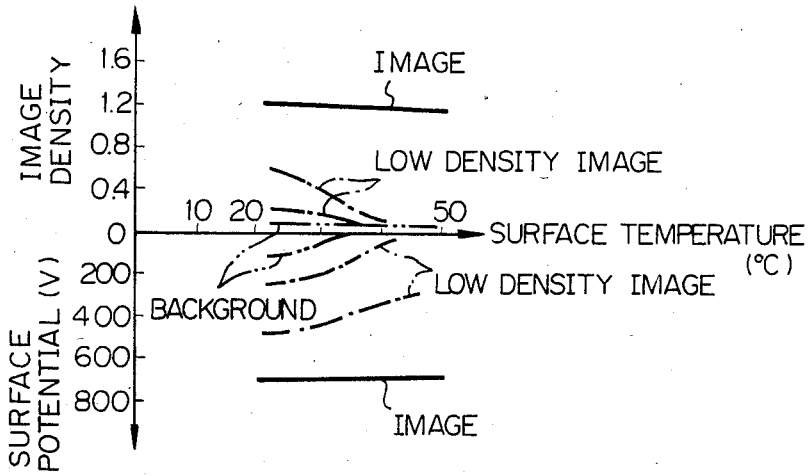
FIG. 3 is a graph showing a relationship between image densities in different areas on the surface of a photoconductive element and a surface potential and a surface temperature of the element in accordance with the prior art device

Before entering into detailed discussion of the present invention, a problem encountered with a prior art device of the kind concerned will be described with reference to FIGS. 1–3. As shown in FIG. 1, an increase in the surface temperature of a photoconductive element is accompanied by a decrease in the dark resistance so that the surface potential is lowered despite a constant amount of charge deposited on the photoconductor, resulting in a decrease in the density of a developed image. It has been customary, therefore, to increase a charging current to the photoconductor, i.e., a voltage applied to a charger, in response to an elevation of the surface temperature of the photoconductor, thereby increasing the amount of charge to prevent the surface potential from being lowered. However, the temperature of the photoconductor is raised by the subsequent exposure to image light lowering the potential more in a dark area of the photoconductor than in a light area. Thus, even the implementation described above is incapable of eliminating a decrease in the potential in a low density image portion and a background where the surface potential is relatively low, although successful to eliminate it in an image portion where the surface potential is relatively high.

Figure 4:
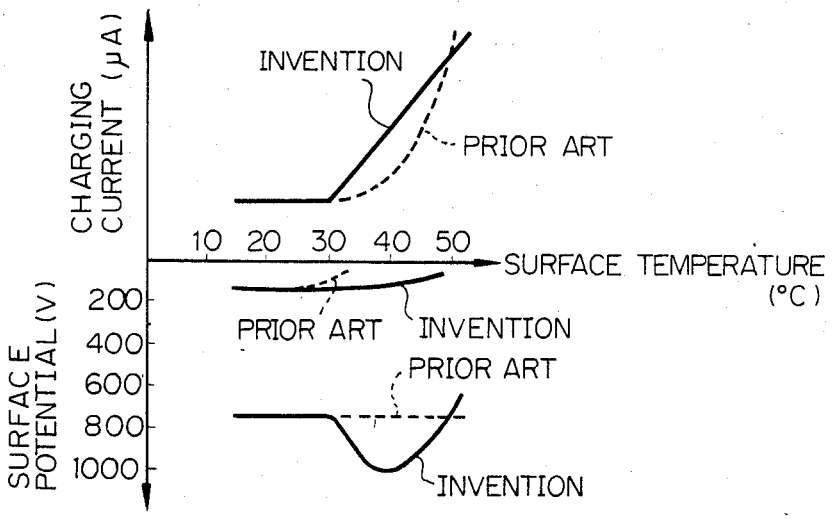
FIG. 4 is a graph showing a relationship between a charging current, and a surface potential and a surface temperature of a photoconductive element attainable with the prior art image control device and that attainable with the present invention.

In accordance with the present invention, the above-described problem is solved by sensing a temperature of at least the surface or its neighborhood of a photoconductor by means of a thermistor or like temperature sensor, and, if it is higher than a predetermined level such as 30° C., linearly increasing the charging current flowing through the photoconductor as shown in FIG. 4, so that the background potential on the photoconductor surface after exposure is maintained substantially constant. In contrast, the prior art practice has been increasing the charging current along a dotted curve in FIG. 4 in response to the temperature elevation of the photoconductor, thereby controlling the potential in the image area of the photoconductor to a substantially constant value. This has lowered the background potential to degrade the reproducibility in a low density image the potential of which is relatively close to the background potential. The present invention promotes desirable reproduction of low density images because the background potential is controlled to a substantially predetermined value. Due to the larger rate of increase of the charging current than the prior art system, the system of the present invention may entail an excessive increase in the image potential together with the desirable suppression of the decrease in the background potential, tending to make the density of developed images excessive in the case of high density original images. Nevertheless, high density original image can be coped with by lowering a toner density in a developer or varying a bias voltage for development or the like, so that the amount of the toner to be deposited on an image area may be limited.

Figure 5:
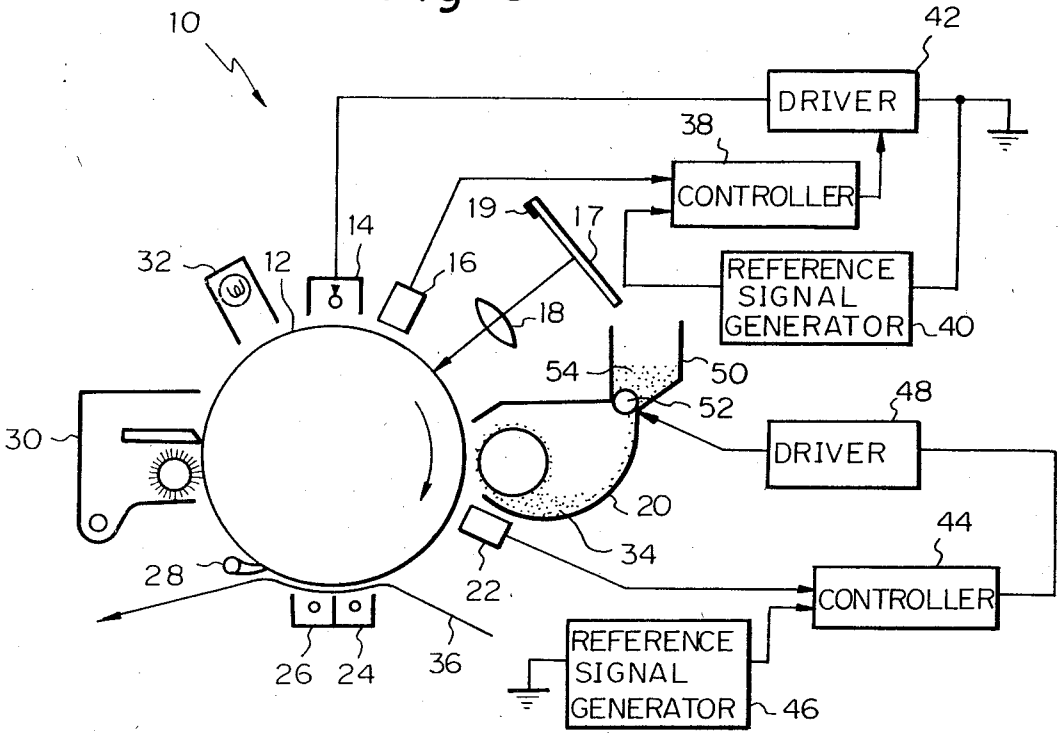
FIG. 5 is a schematic view of an exemplary electrophotographic copier to which an image control device embodying the present invention is applied.

Referring to FIG. 5, an electrophotographic copier to which an image control device of the present invention is applied is shown and generally designated by the reference numeral 10. The copier includes a photoconductive drum 12. Disposed around the drum 12 are a charger 14, a temperature sensor 16, an imaging system 18, a developing unit 20, a photosensor 22, a transfer charger 24, a separator charger 26, a separator pawl 28, a cleaning unit 30, a lamp 32 for charge dissipation, and the like. The charger 14 deposites a uniform electrostatic charge of a predetermined polarity on the surface of the drum 12 and, then, image light representing a desired document 17 is focused by the imaging system 18 to the drum surface. The image light selectively dissipates the charge on the drum 12 to form thereon an electrostatic latent image which represents an image on the document. The developing unit 20 supplies a toner-containing developer 34 to the drum 12 to develop the latent image. In detail, a toner contained in the developer 34 is charged to a polarity opposite to that of the latent image by friction thereof with a carrier and, thereby, electrostatically deposited on the latent image. A paper sheet 36 is overlaid on the toner image on the drum 12 in the position where the transfer chager 24 is located, which deposites a charge of a polarity which tends to attract the toner image. As a result, the toner image is transferred from the drum 12 to the paper sheet 36. The charger 26 expels the charge from the paper sheet 36, whereafter the pawl 28 separates the sheet 36 from the drum surface and directs it toward a fixing unit (not shown). Meanwhile, the cleaning unit 30 removes any residual charge from the drum surface and, then, the lamp 32 clears the drum surface of any residual potential.

In the electrophotographic copier described above, the temperature sensor 16 senses a temperature in the vicinity of the surface of the drum 12 and an output signal thereof is applied to a control circuit 38. The control circuit 38 compares the sensor output with an output signal of a reference signal generator 40. The output of the temperature sensor 16 and that of the refererence signal generator 40 have been individually converted into voltages; the output voltage of the reference signal generator 40 corresponds to a drum temperature of about 30° C. When the output of the temperature sensor 16 represents a drum temperature higher than 30° C., the control circuit 38 activates a drive circuit 42 such that the voltage applied to the charger 14 is made higher to increase the amount of charge deposited on the drum surface. This prevents the background potential from lowering despite the temperature elevation of the drum 12. The rate of increase of the voltage applied to the charger 14 is predetermined relative to the temperature elevation based on experimental results and it is controlled by the controller 38. To increase the charge amount, use may be made of a scorotron whose grid voltage is variable.

The photosensor 22 is located downstream of the developing unit 20 with respect to the direction of rotation of the drum 12. The photosensor 22 is adapted to sense a density of a reference image density pattern 19 which is positioned, for example, in a predetermined portion of a glass platen (not shown) such that it will be formed in a marginal region on the drum surface outside an image forming region. The voltage-converted output of the photosensor 22 is compared by a control circuit 44 with a reference signal voltage which is output from a reference signal generator 46 and representative of a reference image density. When the output voltage of the photosensor 22 has increased beyond that of the reference signal generator 46, the controller 44 drives a drive circuit 48 determining that the density of the reference image density pattern 19 has been lowered. The driver 48 causes a roller 52 in a toner supply device 50 associated with the developing unit 20 to rotate for a predetermined period of time, so that a predetermined amount of a toner 54 is supplied from the device 50 to the developing unit 20 to increase the toner density in the developer 34. Such a toner density control device has been proposed in various forms as described in Japanese Patent Publication No. 43-16199, for example.

Figure 6:
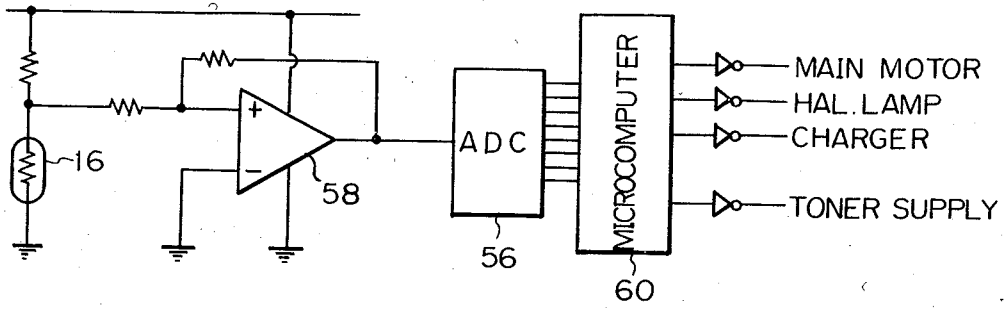
FIG. 6 is a circuit diagram representing another embodiment of the present invention.

While the image control system with the temperature sensor 16 and the image control system with the photosensor 22 have been shown and described as comprising independent circuitries, they may be combined in a single circuitry. An example of the single circuitry design is shown in FIG. 6. In FIG. 6, the output of the temperature sensor 16 is applied to an analog-to-digital converter (ADC) 56 via an amplifier 58. In response to an output of the ADC 56, a microcomputer 60 supplies a control signal for controlling the voltage applied to the charger 14. Also, in response to a signal coming in through another line, the microcomputer 60 generates a toner supply control signal.

Figure 7:
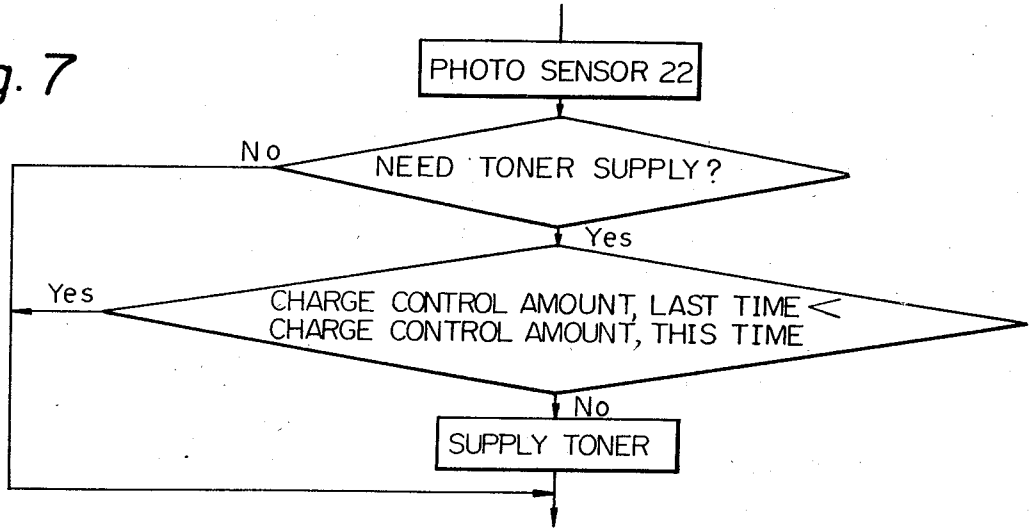
FIG. 7 is a flowchart relating to a toner supply control in accordance with the present invention.

Meanwhile, because the image control device in accordance with the present invention tends to allow an excessive quantity of the toner to be deposited on a high density image region as previously discussed, it is desirable to regulate the density of the toner in the developer. In light of this, an arrangement is made such that, as shown in FIG. 7, when a toner supply signal has appeared in response to an output of the photosensor 22 responsive to a reference image density, the toner is supplied only if the quantity of charge control performed this time in response to a sensed drum temperature is smaller than that performed last time. In the otherwise condition, the quantity of toner supply is reduced or the toner supply is interrupted altogether.

In summary, it will be seen that the present invention provides an image control device for an electrophotographic copier which prevents the potentials in the background and low density image regions from being lowered even when the temperature of a photoconductive drum is elevated, thereby insuring desirable reproduction of even low density documents and low contrast documents. This advantage is derived from the inherent construction wherein the amount of charge on a photoconductive element is controlled in response to a sensed surface temperature of the photoconductor so as to maintain the background potential after exposure substantially constant. The image control device in accordance with the present invention will further enhance the accuracy of image control when combined with an image density sensing type control system known in the art.

Various modifications will become possible for those skilled in the art after receiving the teachings of the present disclosure without departing from the scope thereof.

What is claimed is:

1. An image control device for an electrophotographic copier which includes a photoconductive element, a charger for depositing a uniform electrostatic charge on a surface of the photoconductive element, and a developing unit for supplying a toner, said image control device comprising:

surface temperature sensor means for sensing a temperature in the vicinity of the surface of the photoconductive element to generate a surface temperature signal which has a level corresponding to the sensed temperature;

reference temperature signal generator means for generating a reference temperature signal having a level which corresponds to a predetermined reference temperature;

charger control means for comparing the level of the surface temperature signal with the level of the reference temperature signal and generating a charger drive signal when the level of surface temperature signal is higher than the level of the reference temperature signal;

charger drive means for increasing a voltage applied to the charger in response to the charger drive signal, thereby increasing an amount of charge on the surface of the photoconductive element in accordance with a predetermined function of the surface temperature signal such that a potential in a background on the surface of the photoconductive element is kept constant;

said predetermined function comprising increasing the charging voltage in such a manner that a charging current is increased substantially in proportion to the sensed temperature.

2. An image control device as claimed in claim 1, in which the predetermined reference temperature is 30° C.

3. An image control device as claimed in claim 1, in which the charger comprises a scorotron, the charger drive means being constructed to increase the amount of charge on the surface of the photoconductive element by varying a grid voltage of the scorotron.

4. An image control device as claimed in claim 1, further comprising:

a reference image density pattern arranged in the copier such that an image thereof is formed in a region of the photoconductive element outside an image forming region;

pattern density sensor means for sensing a density of the reference image density pattern to generate a pattern density signal having a level which corresponds to the sensed density;

reference image density signal generator means for generating a reference image density signal having a level which corresponds to a predetermined reference image density;

developing unit control means for comparing the level of the pattern density signal with the level of the reference image density signal and generating a developing unit drive signal when the level of the pattern density signal is higher than the level of the reference image density signal; and developing unit drive means for controlling the developing unit in response to the developing unit drive signal such that the density of the toner is increased by a predetermined amount.

5. An image control device as claimed in claim 4, in which the charger control means and the developing unit control means are constructed integrally with each other.

6. An image control device for an electrophotographic copier which includes a photoconductive element, a charger for depositing a uniform electrostatic charge on a surface of the photoconductive element, and a developing unit for supplying a toner, said image control device comprising:

surface temperature sensor means for sensing a temperature in the vicinity of the surface of the photoconductive element to generate a surface temperature signal which has a level corresponding to the second temperature;

reference temperature signal generator means for generating a reference temperature signal having a level which corresponds to a predetermined reference temperature;

charger control means for comparing the level of the surface temperature signal with the level of the reference temperature signal and generating a charger drive signal when the level of surface temperature signal is higher than the level of the reference temperature signal;

charager drive means for increasing a voltage applied to the charger by a predetermined amount in response to the charger drive signal, thereby increasing an amount of charge on the surface of the photoconductive element;

whereby a potential in a background on the surface of the photoconductive element is kept constant;

a reference image density pattern arranged in the copier such that an image thereof is formed in a region of the photoconductive element outside an image forming region;

pattern density sensor means for sensing a density of the reference image density pattern to generate a pattern density signal having a level which corresponds to the sensed density;

reference image density signal generator means for generating a reference image density signal having a level which corresponds to a predetermined reference image density;

developing unit control means for comparing the level of the pattern density signal with the level of the reference image density signal and generating a developing unit drive signal when the level of the pattern density signal is higher than the level of the reference image density signal; and developing unit drive means for controlling the developing unit in response to the developing unit drive signal such that the density of the toner is increased by a predetermined amount;

the developing unit control means being further constructed to control the developing unit drive means such that, in response to the developing unit drive signal, the developing unit drive means increases the toner density when a quantity of charge control performed this time by the charger drive means is smaller than a quantity of charge control performed last time, and performs one of maintaining the toner density unchanged and lowering the toner density when the charge control quantity performed this time by the charger drive means is larger than the charge control quantity performed last time.

7. An image control device for an electrophotographic copier which includes a photoconductive element formed with a surface made of a material having a dark resistance which decreases as temperature increases and charging means for depositing a uniform electrostatic charge on said surface, comprising:

temperature sensor means for sensing a temperature of said surface; and control means responsive to the temperatrue sensor means for controlling the charging means to adjust a charging voltage in accordance with a predetermined function of sensed temperature such that an electrostatic potential in a background image area on the photoconductive element is controlled to a predetermined value;

said predetermined function comprising increasing the charging voltage when the sensed temperature is above a predetermined value in such a manner that a charging current is increased substantially in proportion to the sensed temperature.

8. An image control device as claimed in claim 7, further comprising:

imaging means for radiating a light image on said surface after charging by the charging means to produce an electrostatic image;

developing means for developing the electrostatic image using a two component developer to produce a toner image;

density sensor means for sensing an optical density of a dark area of the toner image; and control means responsive to the density sensor means for controlling the developing means to adjust a toner density of the developer such that the optical density of the dark area of the toner image is controlled to a predetermined value.

* * * * *